US006843208B2

(12) United States Patent
Tamura et al.

(10) Patent No.: US 6,843,208 B2
(45) Date of Patent: Jan. 18, 2005

(54) CONTROL METHOD FOR PREMIXED COMPRESSION IGNITION INTERNAL COMBUSTION ENGINE

(75) Inventors: Masamitsu Tamura, Kashiwa (JP); Kotaro Hashimoto, Higashi-Murayama (JP); Kohjiroh Aimoto, Wako (JP); Pu Qian, Wako (JP); Takahiro Gunji, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/606,757

(22) Filed: Jun. 27, 2003

(65) Prior Publication Data

US 2004/0089262 A1 May 13, 2004

(30) Foreign Application Priority Data

Jun. 28, 2002 (JP) ..... 2002-189260

(51) Int. Cl.[7] ..... F02B 1/14; F02M 25/00
(52) U.S. Cl. ..... 123/27 R; 123/575; 123/1 A
(58) Field of Search ..... 123/575, 1 A, 123/27 R

(56) References Cited

U.S. PATENT DOCUMENTS 6,022,929 A * 2/2000 Chen et al. ..... 525/333.7

FOREIGN PATENT DOCUMENTS

| | | |
|---|---|---|
| JP | 2000-054874 | 2/2000 |
| JP | 2000-179368 | 6/2000 |
| JP | 2001-050070 | 2/2001 |

* cited by examiner

*Primary Examiner*—Andrew M. Dolinar
*Assistant Examiner*—Katrina Harris
(74) *Attorney, Agent, or Firm*—Arent Fox PLLC

(57) ABSTRACT

There is provided a control method for a premixed compression ignition internal combustion engine, which is capable of responding easily to a sudden change in operating conditions. In a control method for a premixed compression ignition internal combustion engine 5 in which a gaseous mixture of an oxygen-containing gas and a fuel is compressed and self-ignited within a cylinder, cyclohexene is mixed with the fuel to be supplied to the premixed compression ignition internal combustion engine according to the operating conditions of the internal combustion engine.

4 Claims, 1 Drawing Sheet

CONTROL METHOD FOR PREMIXED COMPRESSION IGNITION INTERNAL COMBUSTION ENGINE

BACKGROUND OF THE INVENTION

1. Field of the Invention

The present invention relates to a control method for a premixed compression ignition internal combustion engine in which a gaseous mixture of an oxygen-containing gas and a fuel is compressed and self-ignited within a cylinder.

2. Description of the Related Art

A premixed compression ignition internal combustion engine, in which a gaseous mixture of an oxygen-containing gas such as air and a fuel such as gasoline is compressed and self-ignited within a cylinder, can burn a homogeneous gaseous mixture, and moreover can burn even a very lean gaseous mixture. As a result, the premixed compression ignition internal combustion engine is getting attention as an internal combustion engine that can achieve high fuel efficiency and also can reduce hazardous substances in exhaust gas.

However, the premixed compression ignition internal combustion engine has a problem in that it is difficult to arbitrarily control the ignition timing, which results in abnormal combustion such as knocking because the gaseous mixture is self-ignited. The reason for this is that the self-ignition of the gaseous mixture is dominated by the chemical reactivity inherent in the fuel and hysteresis in pressure and temperature produced by the compression of the gaseous mixture.

Conventionally, there has been known a control method in which the temperature of intake air is changed or exhaust gas after combustion is recirculated to intake air in order to adjust the ignition timing.

However, the conventional control method has a disadvantage that it is difficult to respond to a sudden change in operating conditions of the internal combustion engine.

SUMMARY OF THE INVENTION

The present invention has been made to solve the above problems, and accordingly an object thereof is to provide a control method for a premixed compression ignition internal combustion engine, which is capable of responding easily to a sudden change in operating conditions.

In order to adjust ignition timing in the premixed compression ignition internal combustion engine, mixing of fuels with different self-ignition delay time was conceivable. The inventors conducted studies on the self-ignition delay time of hydrocarbon fuel, and resultantly found that cyclohexene provides significantly long self-ignition delay time.

The inventors further carried on studies based on the above knowledge. As a result, we found that a difference in self-ignition delay time between two kinds of fuels can be controlled easily by mixing cyclohexene with the fuel, and completed the present invention.

To achieve the above object, the present invention provides a control method for a premixed compression ignition internal combustion engine in which a gaseous mixture of an oxygen-containing gas and a fuel is compressed and self-ignited within a cylinder, wherein cyclohexene is mixed with the fuel to be supplied to the premixed compression ignition internal combustion engine, and the mixing amount of cyclohexene is changed according to the operating conditions of the internal combustion engine.

Cyclohexene provides considerably longer self-ignition delay time than that of other fuels. Therefore, in the control method in accordance with the present invention, cyclohexene is mixed with the fuel to be supplied to the premixed compression ignition internal combustion engine, and the amount of cyclohexene mixed with the fuel is changed according to the operating conditions of the internal combustion engine. As a result, according to the control method in accordance with the present invention, the self-ignition delay time can be adjusted, and thereby the ignition timing can be controlled arbitrarily.

Also, in the control method in accordance with the present invention, by changing the amount of cyclohexene mixed with the fuel according to the operating conditions of the internal combustion engine, a sudden change in operating conditions can be accommodated easily in a wide range.

In the control method in accordance with the present invention, the premixed compression ignition internal combustion engine has a first supply means for supplying a first fuel and a second supply means for supplying a second fuel that contains cyclohexene and whose self-ignition delay time is set so as to be longer than that of the first fuel, and the supply amount of the first fuel supplied from the first supply means and the supply amount of the second fuel supplied from the second supply means are changed according to the operating conditions of the internal combustion engine. Thereby, the self-ignition delay time of the second fuel containing cyclohexene can be made longer than that of the first fuel, and hence two kinds of fuels with different self-ignition delay time can be obtained.

Thus, in the control method in accordance with the present invention, by changing the supply amounts of the first and second fuels according to the operating conditions of the internal combustion engine, the amount of cyclohexene mixed with fuel can be changed easily.

In the control method in accordance with the present invention, in order to increase a difference in self-ignition delay time between two kinds of fuels, it is preferable that the first fuel consists of fuels other than cyclohexene, and does not contain cyclohexene.

Specifically, the supply amounts of the first and second fuels are changed respectively so that when the internal combustion engine is operated at higher loads, the ratio of the first fuel to all fuel supplied to the internal combustion engine decreases, and when the internal combustion engine is operated at lower loads, the ratio of the first fuel to all fuel supplied to the internal combustion engine increases.

DETAILED DESCRIPTION OF THE PREFERRED EMBODIMENTS

Embodiments of the present invention will now be described in more detail with reference to the accompanying drawings.

Figure 1:
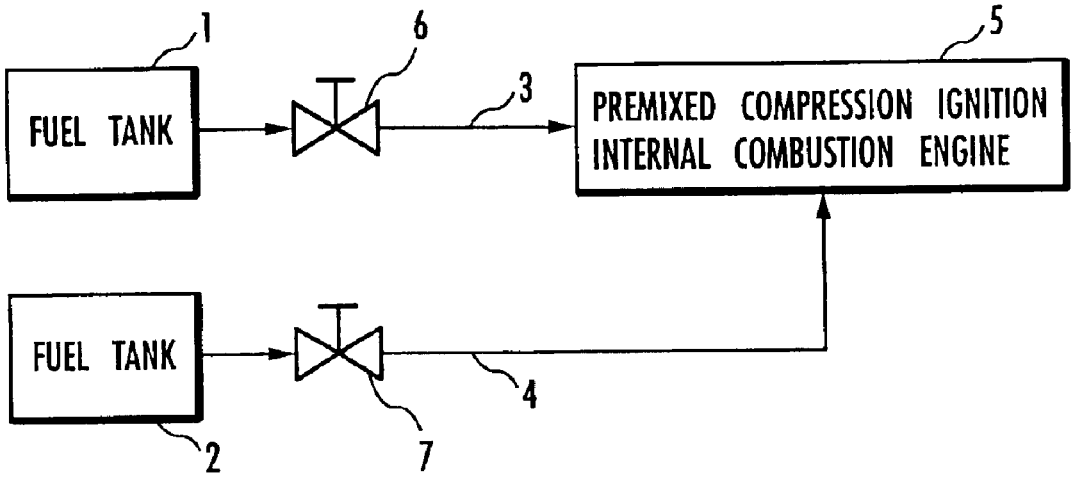
FIG. 1 is a block diagram for illustrating a control method in accordance with one embodiment of the present invention.

A control method of this embodiment can be carried out using an apparatus provided with a fuel tank 1 containing a first fuel and a fuel tank 2 containing a second fuel as shown in FIG. 1. The fuel tank 1 is connected to a premixed compression ignition internal combustion engine 5 via a feed pipe 3, and the fuel tank 2 is connected to a premixed compression ignition internal combustion engine 5 via a feed pipe 4, so that the first and second fuels are mixed with each other within the premixed compression ignition internal combustion engine 5. At some midpoint in the feed pipes 3 and 4, regulating valves 6 and 7 are provided, respectively, so that the supply amounts of the first and second fuels can be changed.

In this embodiment, the first fuel does not contain cyclohexene and the second fuel contains cyclohexene so that the second fuel has longer self-ignition delay time than the first fuel.

In this embodiment, the openings of the regulating valves 6 and 7 are regulated according to the operating conditions of the premixed compression ignition internal combustion engine 5 to change the amounts of the first and second fuels supplied to the premixed compression ignition internal combustion engine 5. At this time, the openings of the regulating valves 6 and 7 are regulated in such a manner that the supply amounts of the first and second fuels are changed respectively so that when the premixed compression ignition internal combustion engine 5 is operated at higher loads, the ratio of the first fuel to all fuel supplied to the internal combustion engine 5 decreases, and the supply amounts of the first and second fuels are changed respectively so that when the premixed compression ignition internal combustion engine 5 is operated at lower loads, the ratio of the first fuel to all fuel supplied to the internal combustion engine 5 increases.

In this embodiment, by regulating the openings of the regulating valves 6 and 7 as described above, the ignition timing of the premixed compression ignition internal combustion engine 5 can be adjusted, and hence even a sudden change in operating conditions can be accommodated easily.

Figure 2:
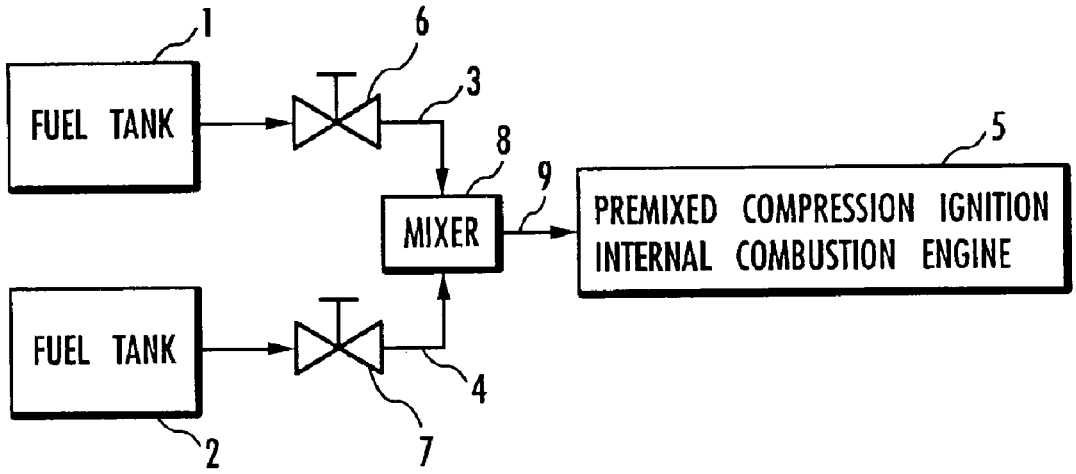
FIG. 2 is a block diagram for illustrating a control method in accordance with another embodiment of the present invention.

Although the first and second fuels are mixed with each other within the premixed compression ignition internal combustion engine 5 in this embodiment, the first and second fuels may be mixed within a mixer 8 that is connected with the feed pipes 3 and 4 as shown in FIG. 2. A mixture of the first and second fuels that is obtained within the mixer 8 is supplied to the premixed compression ignition internal combustion engine 5 through a feed pipe 9.

Next, the measurement result of self-ignition delay time for various kinds of fuels, which was obtained using a constant-volume high-pressure combustion tester (manufactured by American Petro Chemical (Japan) LTD., trade name: FIA-100), is given in Table 1. This tester is configured so that a cylindrical combustion chamber with a volume of about 700 ml is charged in advance with air of predetermined pressure and temperature, fuel is injected through a nozzle provided at the upper part of the combustion chamber, and self-ignition delay time is measured using a pressure monitor. In this embodiment, self-ignition delay time was measured under conditions of a temperature of 550° C., a pressure of 4.0 MPa, and a fuel injection amount of 0.08 ml per one cycle.

TABLE 1

| | Motor octane number | Self-ignition delay time (ms) |
|---|---|---|
| Normal pentane | 62.6 | 4.1 |
| 1-hexene | 63.4 | 7.1 |
| Cyclohexene | 63.0 | 21.9 |
| 2,2,4-trimethylpentane | 100.0 | 16.1 |

It is apparent from Table 1 that the self-ignition delay time for cyclohexene is far longer than that for normal pentane and 1-hexene having an approximately equal motor octane number, and also is longer than that of 2,2,4-trimethylpentane that is an antiknock standard fuel and has a motor octane number of 100.

Therefore, it is apparent that by adding cyclohexene to one fuel and adding no cyclohexene to the other fuel, a difference in self-ignition delay time between two kinds of fuels can be controlled easily.

In this embodiment, the first fuel contains no cyclohexene, and the second fuel contains cyclohexene. However, cyclohexene can also be mixed with the first fuel. In this case, cyclohexene should be mixed to an extent such that the second fuel has longer self-ignition delay time than the first fuel.

What is claimed is:

1. A control method for a premixed compression ignition internal combustion engine in which a gaseous mixture of an oxygen-containing gas and a fuel is compressed and self-ignited within a cylinder, wherein cyclohexene is mixed with the fuel to be supplied to said premixed compression ignition internal combustion engine, and the mixing amount of cyclohexene is changed according to the operating conditions of said internal combustion engine.

2. The control method for a premixed compression ignition internal combustion engine according to claim 1, wherein said premixed compression ignition internal combustion engine has first supply means for supplying a first fuel and second supply means for supplying a second fuel that contains cyclohexene and whose self-ignition delay time is set so as to be longer than that of said first fuel, and the supply amount of the first fuel supplied from the first supply means and the supply amount of the second fuel supplied from the second supply means are changed according to the operating conditions of said internal combustion engine.

3. The control method for a premixed compression ignition internal combustion engine according to claim 2, wherein the first fuel consists of fuels other than cyclohexene.

4. The control method for a premixed compression ignition internal combustion engine according to claim 2, wherein the supply amounts of the first and second fuels are changed respectively so that when said premixed compression ignition internal combustion engine is operated at higher loads, the ratio of said first fuel to all fuel supplied to said internal combustion engine decreases, and the supply amounts of the first and second fuels are changed respectively so that when said premixed compression ignition internal combustion engine is operated at lower loads, the ratio of said first fuel to all fuel supplied to said internal combustion engine increases.

* * * * *